US005470495A

United States Patent [19]

Delfort et al.

[11] Patent Number: 5,470,495

[45] Date of Patent: Nov. 28, 1995

[54] COLLOIDAL PRODUCTS CONTAINING CALCIUM AND/OR MAGNESIUM, AS WELL AS BORON AND/OR PHOSPHORUS AND/OR SULFUR, THEIR PREPARATION AND THEIR UTILIZATION AS ADDITIVES FOR LUBRICANTS

[75] Inventors: Bruno Delfort, Paris; Bertrand Daoudal, Pontigny; Jacques Lallement, Aubervilliers; Maurice Born, Nanterre; Jean-Claude Hipeaux, Colombes; Pierre Marchand, Orgeval; Francoise Dixmier, Sceaux; Monique Prigent, Saint Germain En Laye, all of France

[73] Assignee: Institut Francais Du Petrole, Rueil Malmaison, France

[21] Appl. No.: 155,509

[22] Filed: Nov. 18, 1993

[30] Foreign Application Priority Data

Nov. 18, 1992 [FR] France ..... 92 13934

[51] Int. Cl.[6] ..... C10M 135/10; C10M 159/12

[52] U.S. Cl. ..... 252/18; 252/33.3; 252/33.4; 252/49.6; 252/49.8; 252/56 R

[58] Field of Search ..... 252/18, 33.2, 33.4, 252/56, 49.6, 49.8

[56] References Cited

U.S. PATENT DOCUMENTS

| | | | |
|---|---|---|---|
| 2,417,429 | 3/1947 | McLennan | 252/36 |
| 3,480,548 | 11/1969 | Hellmuth et al. | 252/33.4 |
| 3,714,042 | 1/1973 | Greenough | 252/33.2 |
| 4,328,111 | 5/1982 | Watson et al. | 252/33.4 |
| 4,560,489 | 12/1985 | Muir et al. | 252/18 |
| 5,080,812 | 1/1992 | Parc et al. | 252/18 |
| 5,308,514 | 5/1994 | Olson et al. | 252/18 |
| 5,346,636 | 9/1994 | Parc et al. | 252/18 |

FOREIGN PATENT DOCUMENTS

| | | |
|---|---|---|
| 0536020 | 4/1993 | European Pat. Off. . |
| 05629212 | 9/1993 | European Pat. Off. . |
| 2554825 | 5/1985 | France . |
| 912561 | 12/1962 | United Kingdom . |
| WO88/04686 | 6/1988 | WIPO . |
| WO88/07073 | 9/1988 | WIPO . |

*Primary Examiner*—Jacqueline V. Howard
*Attorney, Agent, or Firm*—Millen, White, Zelano & Branigan

[57] ABSTRACT

Colloidal products according to the invention are obtained by a method comprising a step (a) providing a colloidal product containing at least one alkaline earth metal carbonate in micelle form, optionally reacted with at least one compound selected from alkylsulphonic acids and alkylarylsulphonic acids and salts thereof and long chain aliphatic carboxylic acids and salts thereof such as to modify a proportion of up to 70% of the basicity reserve of the original colloidal product and a step (b) in which the residual basicity reserve is neutralized by at least one acid containing at least one element selected from boron, phosphorus and sulphur. These colloidal products can be used as wear resistance and extreme pressure additives in lubricants.

28 Claims, 7 Drawing Sheets

Figure 1:
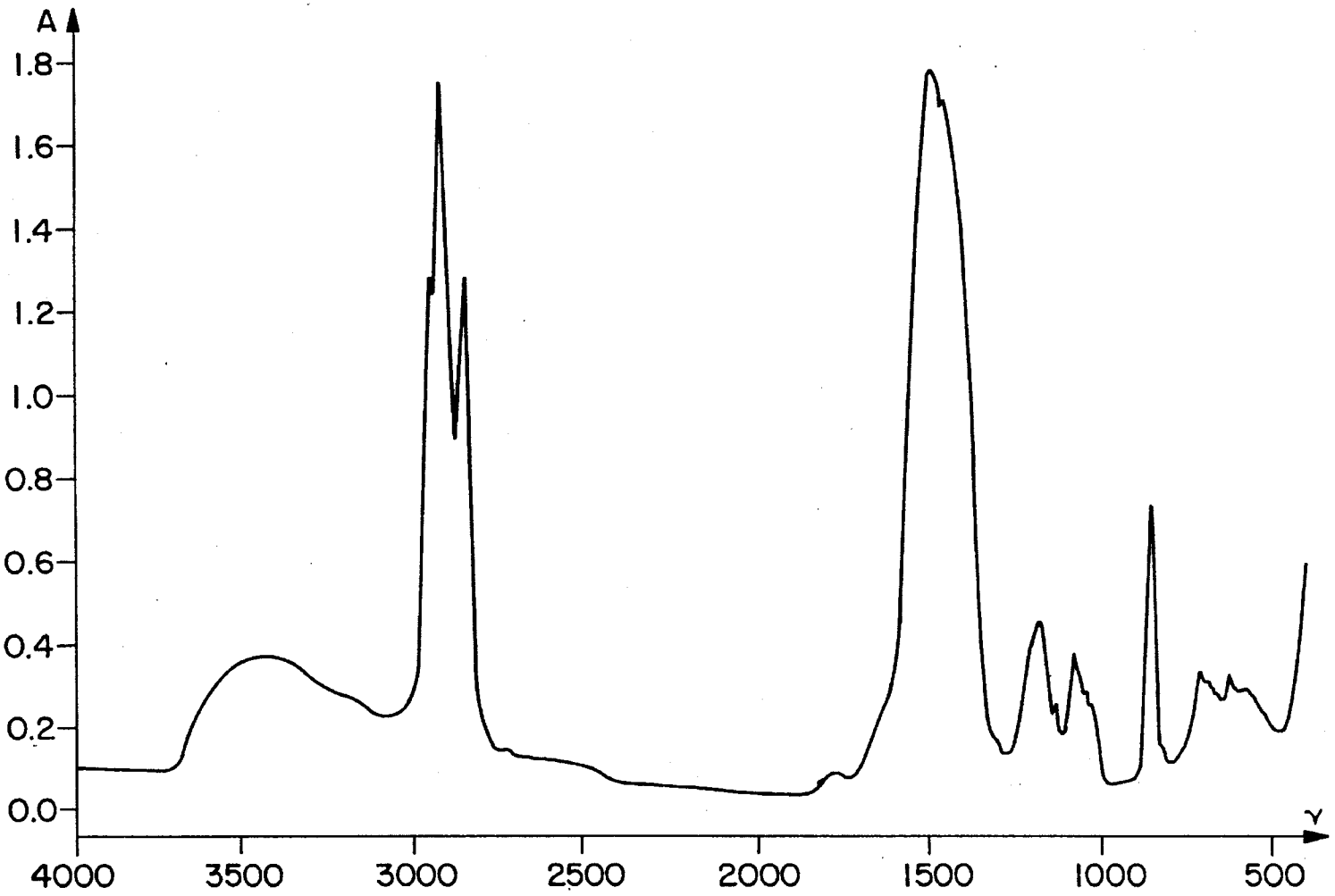
Figure 2:
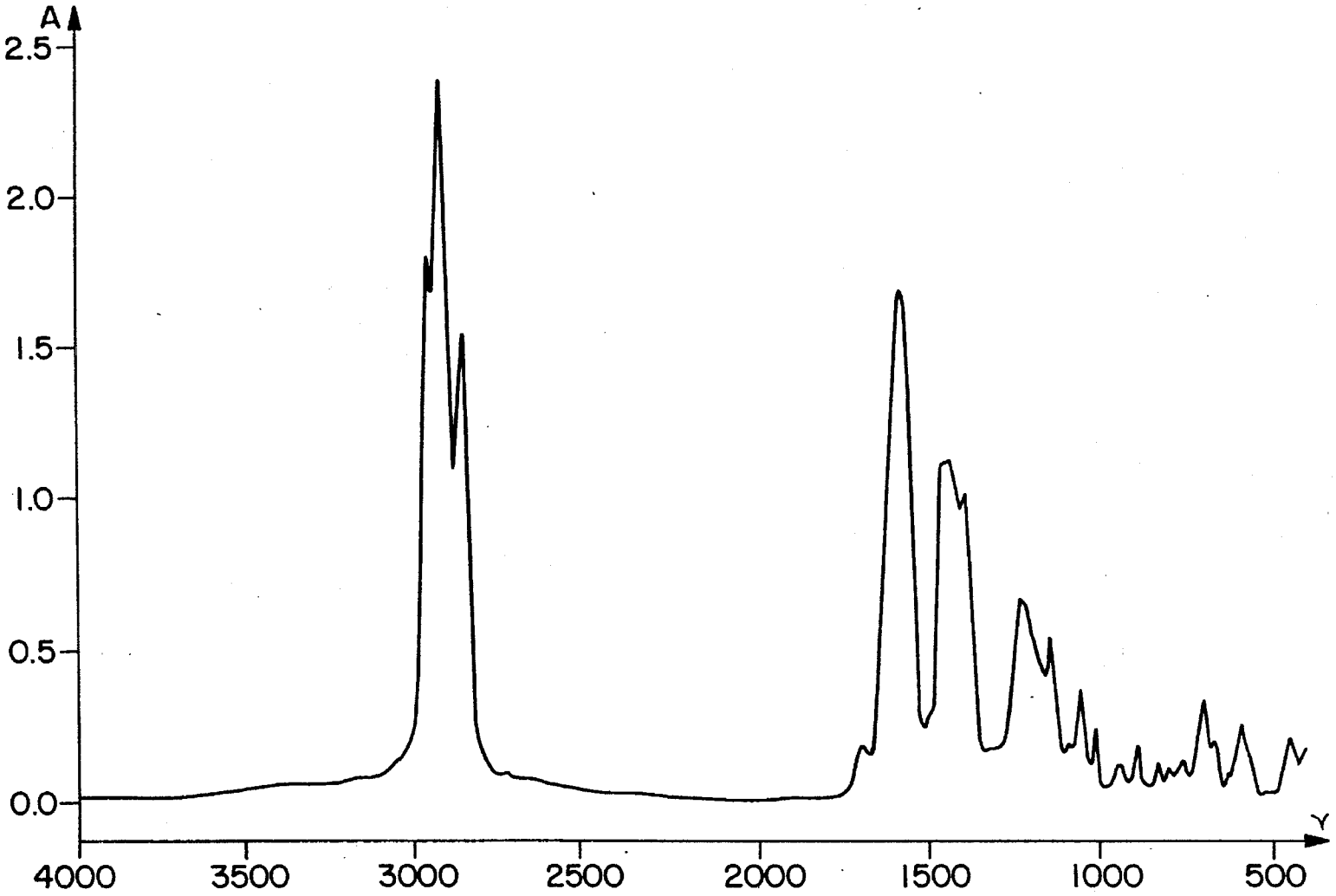
Figure 3:
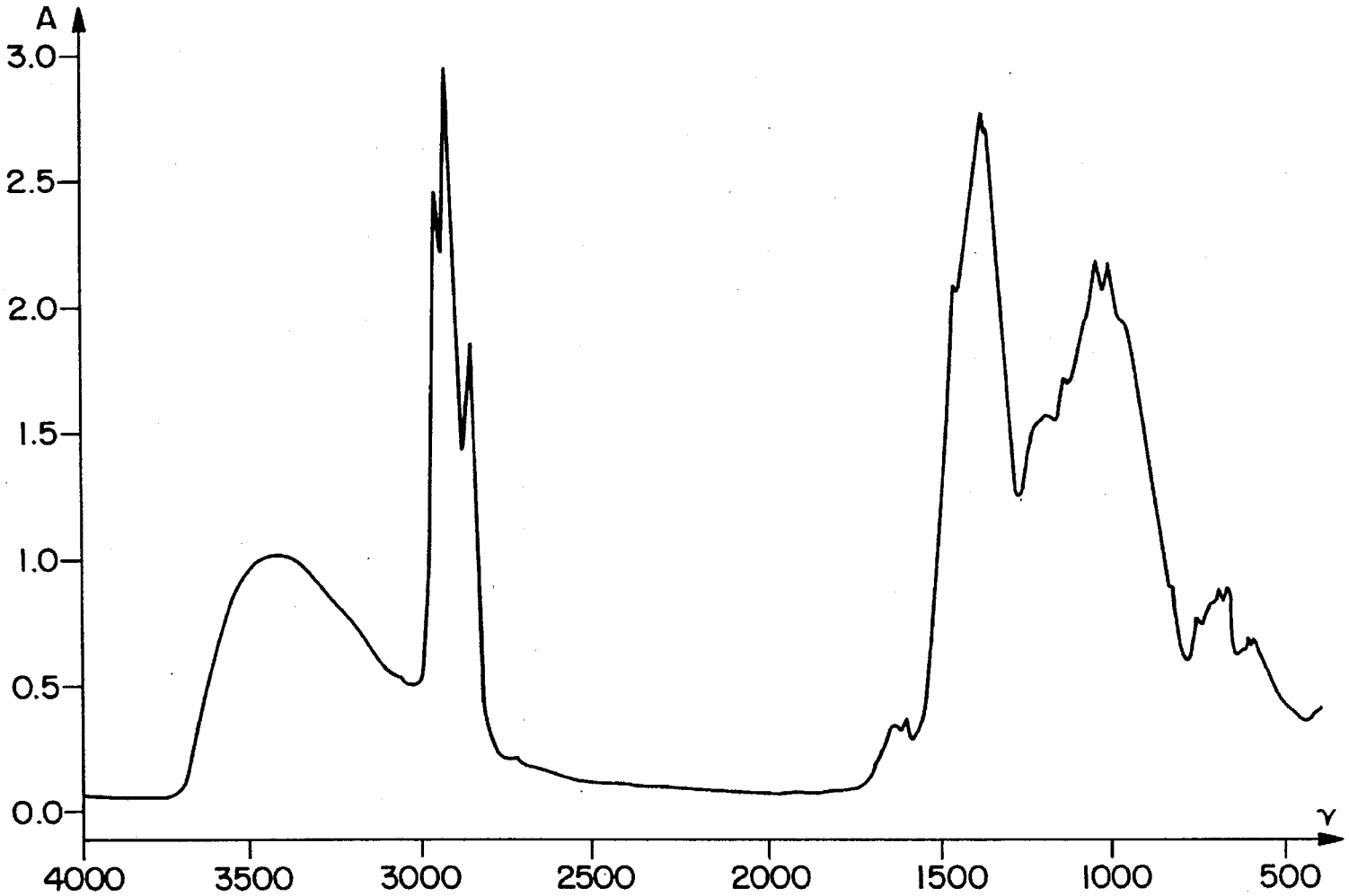
Figure 4:
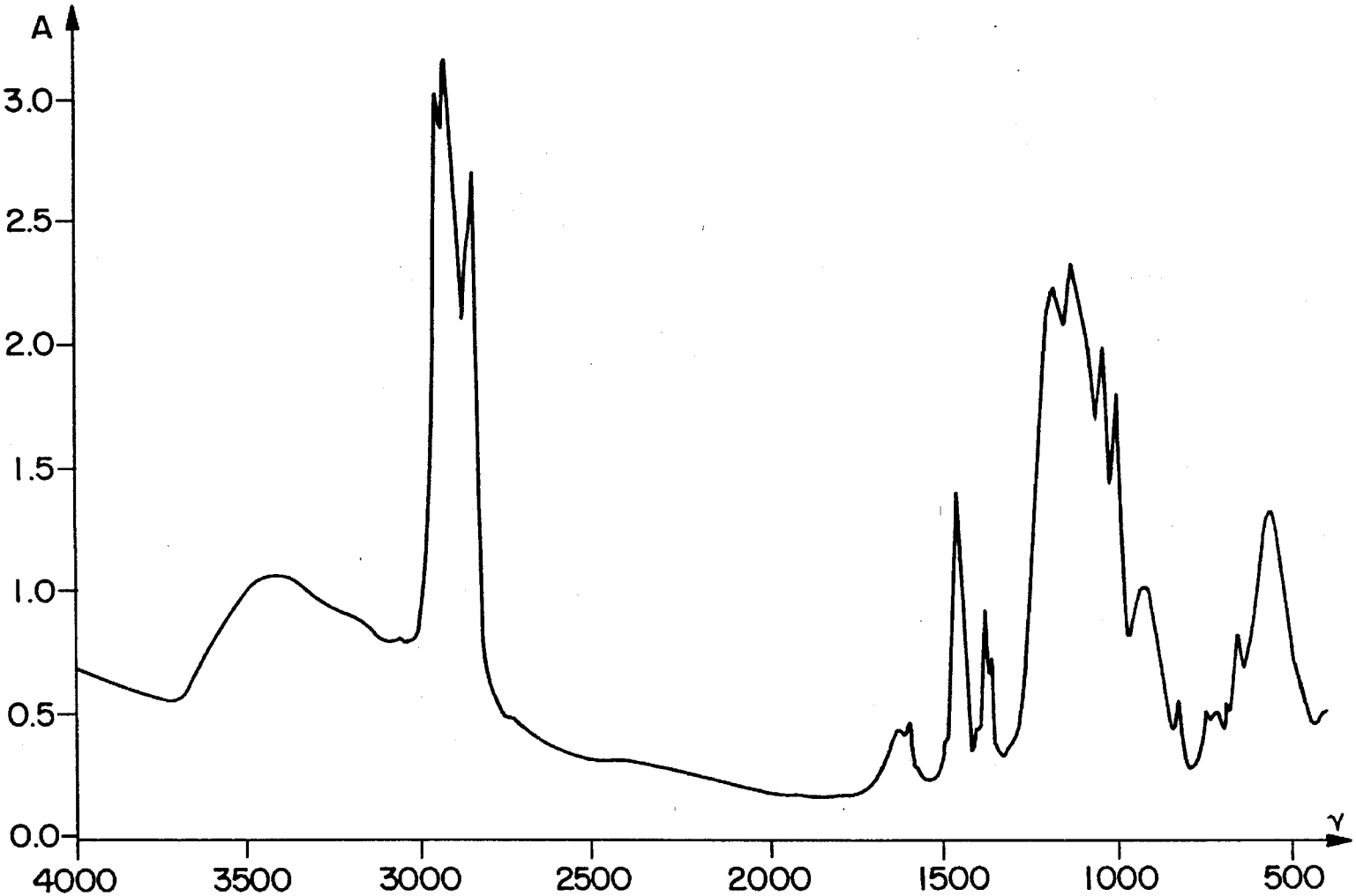

COLLOIDAL PRODUCTS CONTAINING CALCIUM AND/OR MAGNESIUM, AS WELL AS BORON AND/OR PHOSPHORUS AND/OR SULFUR, THEIR PREPARATION AND THEIR UTILIZATION AS ADDITIVES FOR LUBRICANTS

The invention relates to colloidal products containing calcium and/or magnesium as well as boron and/or phosphorus and/or sulphur, their preparation and use as additives for lubricants.

BACKGROUND OF THE INVENTION

Colloidal products are known which are obtained by carbonation of an excess of alkaline earth oxide or hydroxide dispersed in micelles by surface active agents such as sulphonic acids and salts thereof. These products contain an alkaline earth metal carbonate dispersed in colloidal state.

It has already been proposed in the prior art to modify such micelles by different reactions.

In French patent application FR-A-2645168, thiophosphoric compounds are described which are obtained by reaction of a sodium or calcium sulphonate overbased by sodium or calcium carbonate with phosphorus sulphide, generally $P_4S_{10}$, this reaction being possibly followed by reaction with a compound with active hydrogen, which can be water, methanol, isopropanol, a phenol, acetic acid, a dialkylphosphite, boric acid, phosphoric acid, ammonia, an amide, dimercaptothiadiazole, or a derivative thereof. Compounds obtained solubilized in a medium hydrocarbon medium by micellization can be used as wear resistance and extreme pressure additives in lubricating oils.

Furthermore, in published French patent application 2,681,872 (corresponding to published European application 0536020) the applicant describes and claims colloidal products containing boron and phosphorus obtained by a method in which a overbased alkaline or alkaline earth sulphonate containing borax is prepared; this product is reacted with a phosphorus sulphide and the resulting product is separated. These products are also used as wear resistance and extreme pressure additives in lubricating oils and greases. Published French patent application 2689031 (corresponding to published European application 056912) can also be cited, in which colloidal products are described and claimed, which can also be used as wear resistance and extreme pressure additives in lubricating oils. They are defined as being obtained by reaction of an overbased detergent compound (such as an alkaline or alkaline earth sulphonate, phenate, salicylate or naphthenate an overbased by an alkaline or alkaline earth carbonate or hydroxide) with a sulphurated carboxylic acid.

In the cases cited above, modifications brought about to the core of the micelles were partial and residual alkaline or alkaline earth carbonate remained.

SUMMARY OF THE INVENTION

It has now been discovered that it is possible to modify micelles by the action of different acids on the whole of the alkaline reserve of the substrate. The core of the new micelles obtained is now completely devoid of carbonate, but contains alkaline earth metal salts (principally of calcium and/or magnesium) of the acids used. These salts are supposedly intrinsically insoluble in hydrocarbon media. Here, they are solubilized in colloidal form and comprise the core of the micelles.

The technique according to the invention principally consists of modifying the core of an already existing micelle of alkaline earth metal carbonate until a new micelle, devoid of carbonate is obtained, without this affecting the colloidal stability of the products obtained.

In general, colloidal products according to the invention are prepared by a method which includes an optional step (a) of partial modification of the alkaline reserve of a colloidal product containing at least one alkaline earth metal carbonate, by action of a compound selected from alkylsulphonic and alkylarylsulphonic acids and salts thereof and long chain aliphatic carboxylic acids (for example with at least 10 carbon atoms) such as stearic acid and salts thereof, and this modification, when carried out, can affect a proportion of up to 70%, more particularly of 30 to 60% of the basicity reserve of the original colloidal product; and a step (b) of neutralization of the residual basicity reserve of the colloidal product, by at least one so-called "functional" acid, containing boron and/or phosphorus and/or sulphur. Salts formed in step (a) are soluble in oil and are localized at the periphery of the micelle. Salts formed in step (b) are insoluble in oil and form the core of the micelle.

The original substrates are generally formed from alkaline earth metal carbonates (more particularly magnesium and/or calcium) micellized by an overbased sulphonate. They have a basicity reserve which can be, for example, from 200 to approximately 600 ("TBN" or total index of base in mg of potassium hydrogen per g of product).

These substrates are known by the man skilled in the art as superbasic detergent additives. Some of them, and preparation thereof, have been described, for example, in U.S. Pat. Nos. 2,865,956; 3,150,088; 3,537,996; 3,830,739; 3,865,737; 4,148,740; 3,953,519; 3,966,621 and 4,505,830 French patent 2,101,813. Variations of the overbasing reaction exist, which in particular use carbonates preformed from alkoxides and $CO_2$ before being placed in contact with the alkaline or alkaline earth salt of the acid compound; they are described in particular in U.S. Pat. Nos. 2,956,018; 3,932,289 and 4,104,180.

The sulphonic acids used in modification step (a) are known and described in numerous documents, for example in French patent 2,101,813.

In these sulphonic acids, the hydrocarbonated portion of the molecule advantageously has a molecular mass equal to at least 370 to ensure the miscibility of corresponding sulphates in mineral oils. These can be so-called "natural" acids resulting from sulphonation of petroleum fractions or synthetic acids prepared by sulphonation of synthetically prepared batches: alkenylic hydrocarbons, such as polyisobutenes (U.S. Pat. No. 4,159,946), alkylarylic hydrocarbons, such as for example postdodecylbenzenes obtained as a bottom product of the production of dodecylbenzene.

In step (b) of the method for preparation of the colloidal products according to the invention, so-called "functional" acids can be directly introduced into the reaction medium or can be formed in situ.

Examples of functional acids directly introduced can be, for example, boric acids, in particular orthoboric acid or metaboric acid, phosphoric acids and derivatives thereof; as well as sulphurated carboxylic acids which correspond to the general formula: $X—R^1S_x—R^3—S_y—R^3—COOH$, in which $R^1$ and $R^2$ each represent a divalent hydrocarbon radical, for example an alkylene radical with 1 to 6 carbon atoms, or a phenylidene radical, $R^3$ represents a simple bond or a divalent hydrocarbon radical, for example an alkylene radical with 1 to 4 carbon atoms, X represents a hydrogen atom or a carboxylic grouping; x and y each have an average value of 1 to 4 when $R^3$ is a divalent hydrocarbon radical, and the sum (x+y) has an average value of 1 to 4 when $R^3$ represents a simple bond.

More particularly, when $R^3$ is a simple bond and X represents COOH, the carboxylic acids are in the form of:

$$HOOC—R^1—S_{(x+y)}—R^2—COOH$$

for example thio-, dithio-, trithio- and tetrathioglycolic, diproprionic and dibutyric acids, as well as 2,2'-dithiobenzoic acid.

When $R^3$ is a divalent hydrocarbon radical and X is a carboxylic grouping, the acids are in the form of:

$$HOCO—R^1—S_x—R^3—S_yR^2—COOH$$

for example bis-methylene and bis-ethylene (thio-, dithio- and trithioacetic) acids and bis-methylene and bis-ethylene (thio-, dithio- and trithiopropionic) acids.

Finally, when $R^3$ is a simple bond and X is a hydrogen atom, the acids are in the form:

$$HR^1—S_{(x+y)}—R^2—COOH$$

for example ethylthio-, dithio- and trithio-acetic, -propionic and -butyric acids.

Methods for preparation of the sulphurated carboxylic acids have been described in French patent application 2,689,031 already cited above.

When, during preparation of the colloidal products according to the invention, acids are formed in situ, they can, more particularly, be formed from, on the one hand phosphorus sulphides, in particular $P_4S_{10}$ and derivatives thereof, phosphorus oxides, such as $P_2O_5$, boric oxides, such as $B_2O_3$ and mixtures thereof; and on the other hand water and/or an aliphatic monoalcohol, such as for example methanol.

The above acids can be used separately or in mixtures according to different combinations. In particular, at least one acid can be directly introduced, while forming at least one other in situ.

The preparation of colloidal products according to the invention is generally carried out in an organic solvent, which can consist, more particularly, of an aliphatic hydrocarbon (such as, for example, a hexane, a heptane, an octane or a nonane), a cycloaliphatic hydrocarbon (such as, for example cyclohexane), an aromatic hydrocarbon (such as, for example, toluene or a xylene), possibly associated with some tetrahydrofuran or some methanol, used as co-solvents.

In addition, this can also be carried out in the presence of a dilution oil.

The reaction temperature of steps (a) and (b)is, for example, from ambient temperature up to the reflux temperature of the solvent used.

The products according to the invention are characterized by their high content of boron and/or sulphur and/or phosphorus in colloidal state. The content of the active elements is higher than those observed in the prior art during partial modification of micelles containing calcium carbonate and/or sodium carbonate, for example, in French patent application 2,681,872 and in French patent application 2,689,031 cited above.

The sulphur content of the colloidal products according to the invention can therefore be, for example, up to approximately 30% by weight, the boron content up to approximately 15% by weight and the phosphorus content up to approximately 15% by weight, these percentages being calculated with respect to the by weight of active material. Moreover, the calcium and/or magnesium content of the colloidal products according to the invention can be, for example, up to approximately 25% by weight. In these products, the calcium and magnesium are no longer in the form of carbonates as has been shown by the infrared spectra of the products, which does not include a band corresponding to the carbonate ion. This confirms the complete substitution of carbonates in the core of the micelle by salts of the acids introduced. Furthermore, dialysis experiments allow the localization of the boron and/or sulphur and/or phosphorus in the dialysis concentrate, thereby confirming micellization of the salts formed and the intrinsic insolubility in oils thereof.

Colloidal products containing boron and/or sulphur and/or phosphorus according to the invention make excellent wear resistance and extreme pressure additives. Wear resistance and extreme pressure additives are incorporated in lubricants when they are for lubricating parts subjected to high mechanical stresses, such as distribution in heat engines, gears, roller bearings and axial bearings. High mechanical stresses also occur during metal machining involving cutting or shaping.

Furthermore, the colloidal products containing boron and/or sulphur and/or phosphorus according to the invention possess great thermal stability which means that they can be used in lubricants subjected to operation at very high temperatures, which can reach 160° C., as in certain crankcases in supercharged engines, in highly loaded transmissions or in high speed metal cutting.

When using the products according to the invention as additives for lubricating oils and greases, they can be incorporated therein, for example, in a concentration of 0.1 to 25% by weight, preferably of 1 to 15% by weight.

Lubricating oils (or greases) generally also contain one or more additives such as additives for improving the viscosity index, additives for lowering the pour point, antioxidants, anti-corrosives, additives for preventing copper corrosion, anti-foaming additives, dispersants, detergents and friction reducers, with which the products according to the invention are compatible.

Figure 5:
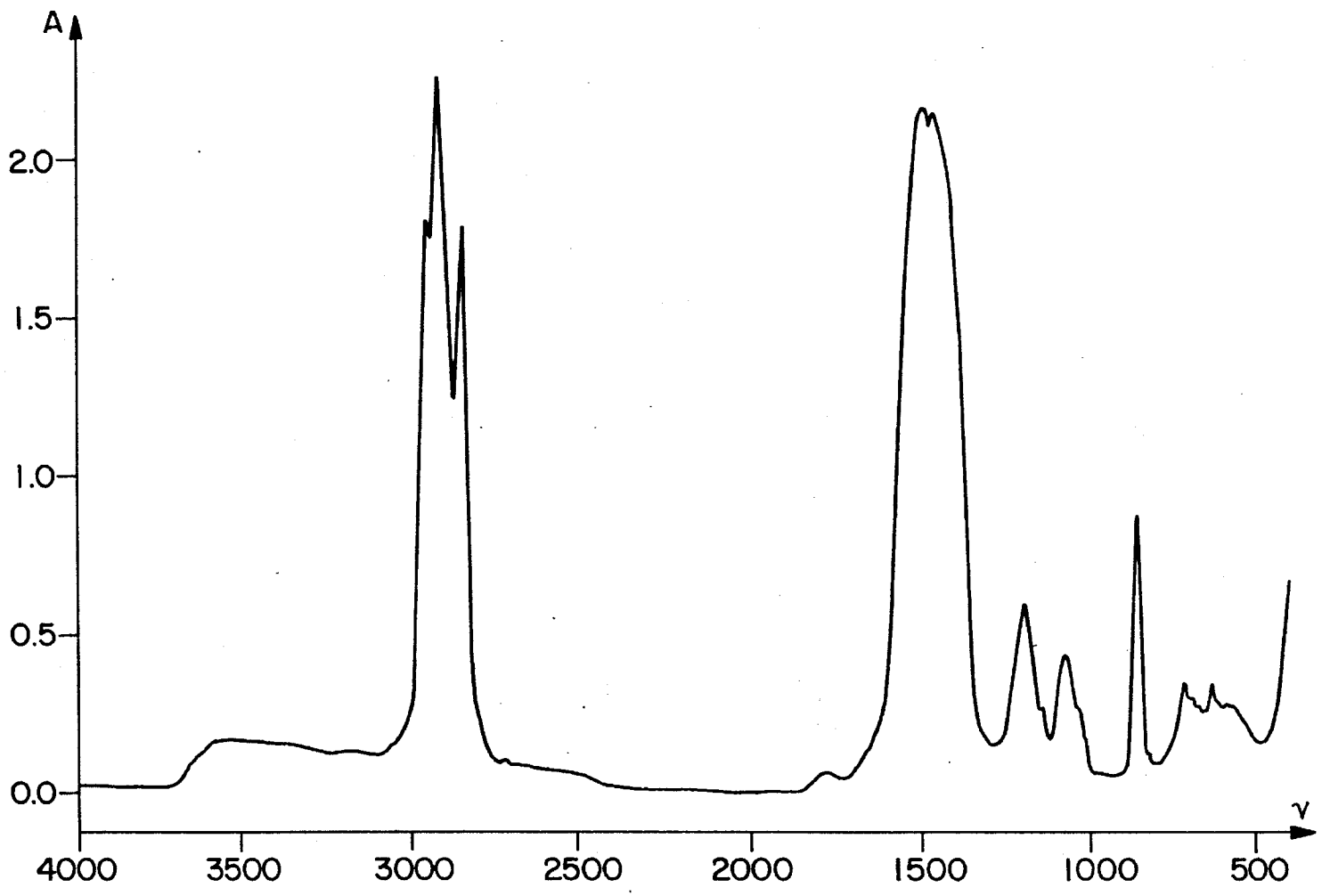
Figure 6:
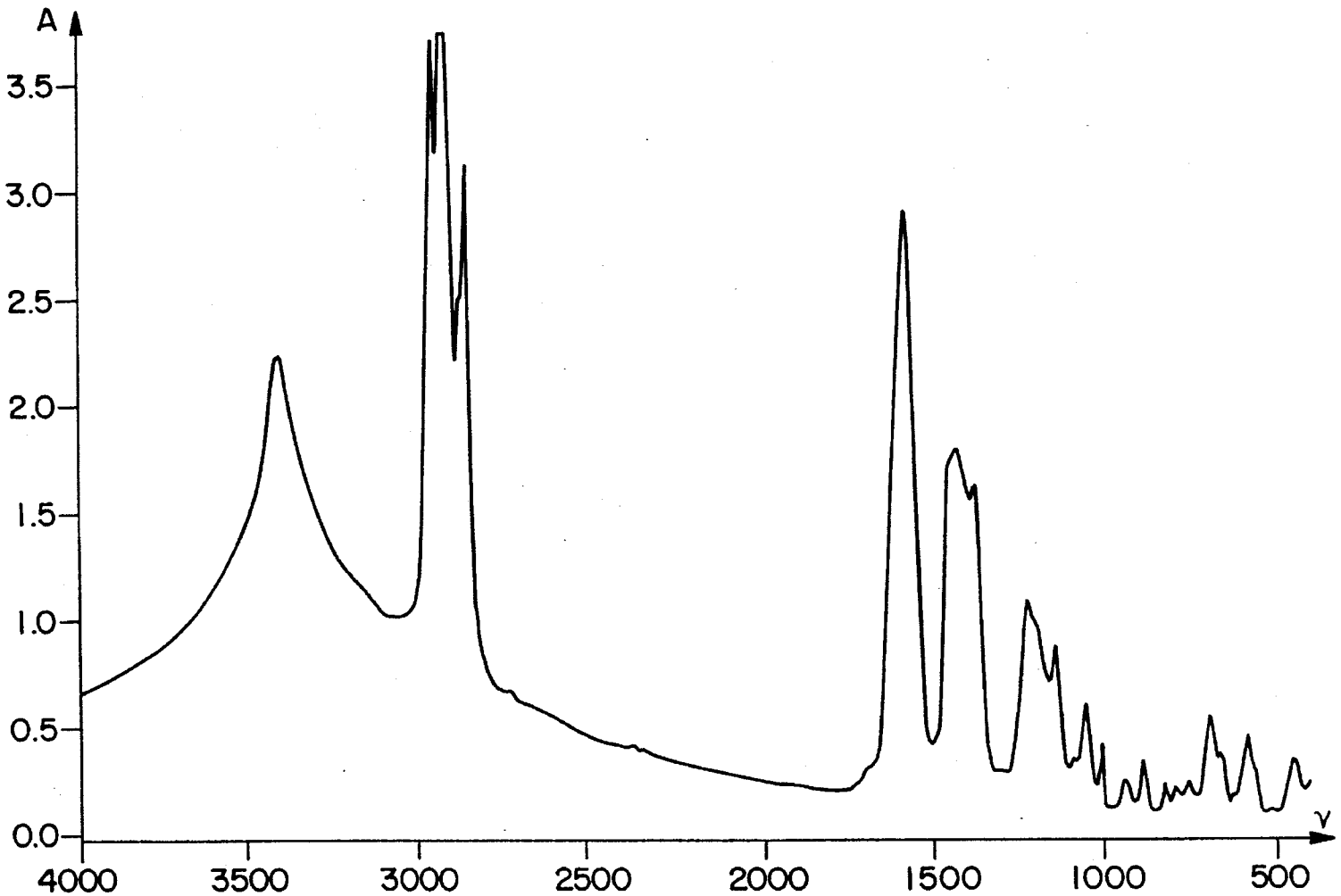
Figure 7:
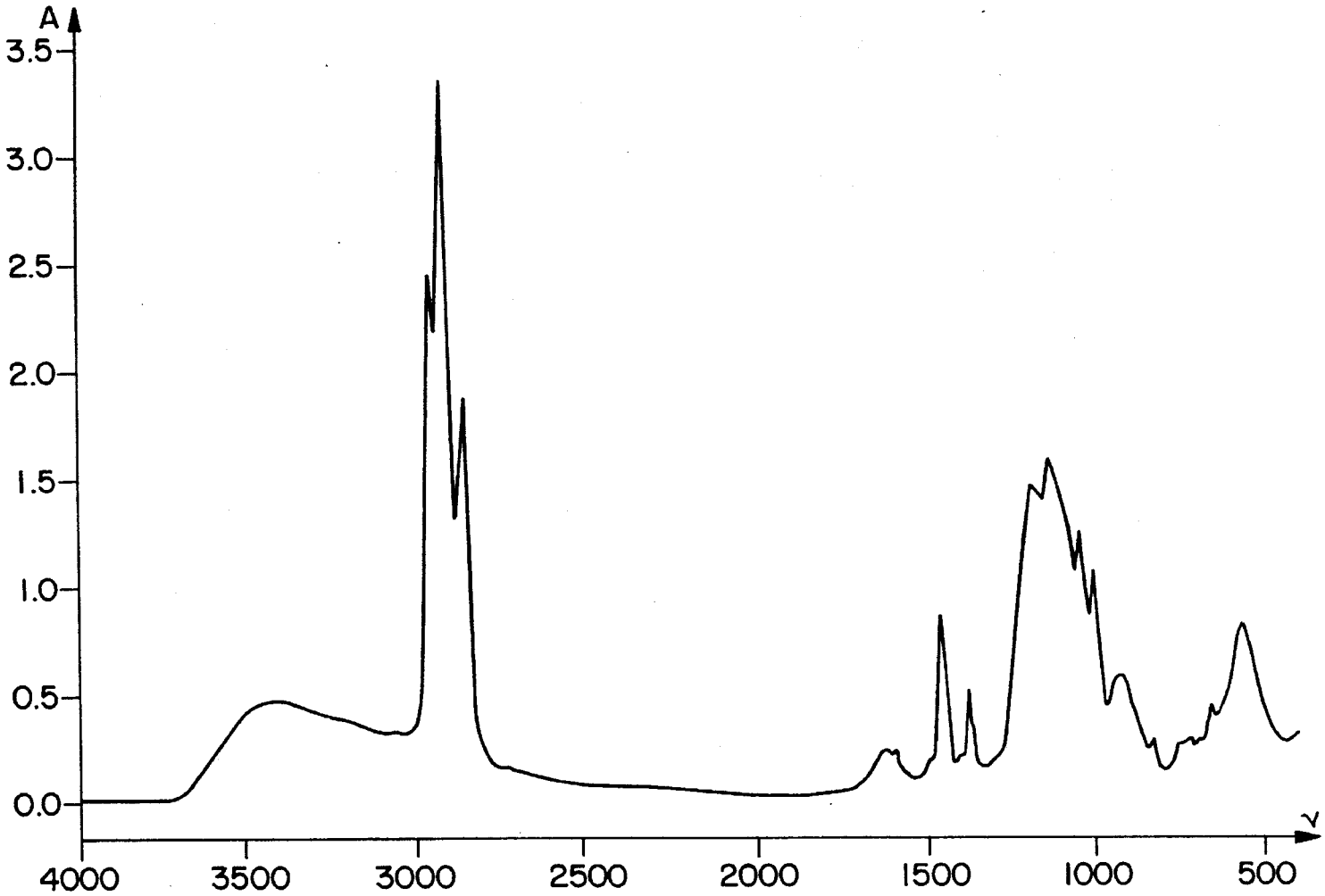

The following examples illustrate the invention. The drawings annexed show infrared spectra of an overbased calcium sulphonate of 500 TBN and the products of examples 2, 4 and 7 (FIGS. 1 to 4)

of an overbased calcium sulphonate of 410 TBN and the products of examples 11 and 12 (FIGS. 5 to 7).

Example 1

50 g of a superbasic calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 65.5 g of an alkylarylsulphonic acid with an average molar by weight equivalent to 700 (that is, 0.094 acid equivalent)in 150 $cm^3$ of xylene. After removal of the reaction water by azeotropic entrainment, there is introduced at a temperature of within the range of 50° C. and 70° C. a solution of 0.176 g (0.352 acid equivalent) of dithioglycolic acid in 80 $cm^3$ of tetrahydrofuran. The total amount of the alkaline reserve is thereby consumed. The addition takes between 1 and 2 hours. Then 200 $cm^3$ of xylene is added, then the tetrahydrofuran and the reaction water is removed by distillation. The medium is maintained at the reflux temperature of xylene for 2 hours. After return to the ambient temperature, 60 g of 130 Neutral oil is added, then the medium is filtered, followed by evaporation under low pressure of the xylene. A homogeneous and limpid product is recovered, containing:

Ca=5.3% by weight

S=6.7% by weight

Example 2

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 32.9 g of an alkylarylsulphonic acid having an average molecular weight equivalent to 700 (that is, 0.047 acid equivalent)in 150 $cm^3$ of xylene. After removal of the reaction water by azeotropic entrainment, there is introduced at a temperature of within the range of 50° C. and 70° C. a solution of 36.3 g (0.40 acid equivalent) of dithioglycolic acid in 80 $cm^3$of tetrahydrofuran. The total amount of the alkaline reserve is thereby consumed. The addition takes between 1 and 2 hours. Then 200 $cm^3$ of xylene is added, then the tetrahydrofuran and the reaction water is removed by distillation. The medium is maintained at the reflux temperature of xylene for 2 hours. After return to the ambient temperature, 40 g of 130 Neutral oil is added, then the medium is filtered, followed by evaporation under low pressure of the xylene. A homogeneous and limpid product is recovered, containing:

Ca=6.1% by weight

S=8.9% by weight

Example 3

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent)in 100 $cm^3$ of xylene. After removal of the reaction water by azeotropic entrainment, 50 $cm^3$ of methanol is introduced into the medium and the Dean and Stark separator is replaced by a Soxhlet device, the cartridge of which is filled with 24.0 g (0.397mole) of orthoboric acid. The reaction mixture is then maintained at reflux until complete dissolution and extraction of the boric acid. The methanol is then distilled, then the reaction water is removed by azeotropic entrainment. After return to the ambient temperature, the medium is filtered, followed by evaporation under low pressure of the xylene. 97.5 g of a homogeneous and limpid product is recovered, containing:

Ca=9.4% by weight

B=4.7% by weight

Example 4

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent)in 100 $cm^3$ of xylene. After removal of the reaction water by azeotropic entrainment, 50 $cm^3$ of methanol is introduced into the medium and the Dean and Stark separator is replaced by a Soxhlet device, the cartridge of which is filled with 48.2 g (0.779 mole) of orthoboric acid. The reaction mixture is then maintained at reflux until complete dissolution of the boric acid. The methanol is then distilled, then the reaction water is removed by azeotropic entrainment. After return to the ambient temperature, the medium is filtered, followed by evaporation under low pressure of the xylene. 107 g of a homogeneous and limpid product is recovered, containing:

Ca=12.3% by weight

B=9.0% by weight

Example 5

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent) in 150 $cm^3$ of xylene. After removal of the reaction water by azeotropic entrainment, 50 $cm^3$ of methanol is introduced into the medium and the Dean and Stark separator is replaced by a Soxhlet device, the cartridge of which is filled with 24.1 g (0.389 mole) of orthoboric acid. The reaction mixture is then maintained at reflux until complete dissolution of the boric acid. The methanol is then distilled, then the reaction water is removed by azeotropic entrainment. The operation is repeated with the same quantity of boric acid. After return to the ambient temperature, 21.8 g of 130 Neutral oil is added, then the medium is filtered, and the xylene is evaporated under low pressure. 130.8 g of a homogeneous and limpid product is recovered, containing:

Ca=9.4% by weight

B=6.4% by weight

Example 6

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 55.2 g of an alkylarylsulphonic acid having an average molecular weight equivalent to 700 (that is, 0.079 acid equivalent)in 150 $cm^3$ of xylene. After removal of the reaction water by azeotropic entrainment, 20.4 g (0.917 mole) of phosphorus pentasulphide is introduced into the reactor at an ambient temperature, and is maintained in a dispersed state by thorough agitation. In 45 minutes, at a temperature not exceeding 50° C., a solution of 16.5 g of water in 80 $cm^3$ of tetrahydrofuran is introduced. The medium is then maintained at 50° C. until the phosphorus pentasulphide disappears, then the tetrahydrofuran and water is removed by distillation. After return to the ambient temperature, the medium is filtered, followed by evaporation under low pressure of the xylene. 101.2 g of a homogenous and limpid product is recovered, containing:

Ca=8.1% by weight

P=5.1% by weight

S=4.0% by weight

Example 7

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 39.2 g of an alkylarylsulphonic acid having an average molecular weight equivalent to 700 (that is, 0.059 acid equivalent)in 150 $cm^3$ of xylene. After removal of the reaction water by azeotropic entrainment, 21.65 g (0.974 mole) of phosphorus pentasulphide is introduced into the reactor at an ambient temperature, and is maintained in a dispersed state by thorough agitation. In 45 minutes, at a temperature not exceeding 50° C., a solution of 8.8 g of water in 80 $cm^3$ of tetrahydrofuran is introduced. The medium is then maintained at 50° C. until the phosphorus pentasulphide disappears, then the tetrahydrofuran and water are removed by distillation. After return to the ambient temperature, the medium is filtered, followed by evaporation under low pressure of the xylene. 94.0 g of a homogenous and limpid product is recovered, containing:

Ca=8.7% by weight

P=5.9% by weight

S=4.0% by weight

Example 8

50 g of an overbased calcium sulphonate with an alkaline reserve (TBN) equivalent to 500 mg of KOH per gram of product (in this case 0.4456 basic equivalent) which is dissolved in 150 $cm^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent) in 150 $cm^3$ of xylene. After removal of the reaction water by azeotropic entrainment, 50 $cm^3$ of methanol is introduced into the medium and the Dean and Stark separator is replaced by a Soxhlet device, the cartridge of which is filled with 6.0 g (0.097 mole) of orthoboric acid. The reaction mixture is then maintained at reflux until complete dissolution and extraction of the boric acid. The methanol is then distilled, then the reaction water is removed by azeotropic entrainment. After return to the ambient temperature, the Soxhlet device is replaced by a draining funnel and 10.8 g (0.049 mole) of phosphorus pentasulphide is dispersed in the medium. In 45 minutes a solution of 4.4 g of water in 50 $cm^3$ of tetrahydrofuran is introduced and now the temperature measures below 50° C. Agitation is continued until total consumption of the phosphorus pentasulphide, then the water and tetrahydrofuran are removed by distillation. After return to the ambient temperature, the medium is filtered and the xylene is evaporated under low pressure. A homogenous and limpid product is recovered, containing:

Ca=9.1% by weight

B=1.1% by weight

P=2.8% by weight

S=2.8% by weight

Example 9

50 g of an overbased calcium sulphonate with an alkaline reserve (TBN) equivalent to 500 mg of KOH per gram of product (in his case 0.4456 basic equivalent) which is dissolved in 150 $om^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent) in 150 $cm^3$ of xylene. After removal of the reaction water by azeotropic entrainment, 10.8 g (0.048 mole) of phosphorus pentasulphide is introduced into the reactor at an ambient temperature, and is maintained in a dispersed state by thorough agitation. In 45 minutes, at a temperature not exceeding 50° C., a solution of 4.4 g of water in 50 $cm^3$ of tetrahydrofuran is introduced. The medium is then maintained at 50° C. until the phosphorus pentasulphide disappears, then the tetrahydrofuran and water are removed by distillation. After return to the ambient temperature, 50 $cm^3$ of methanol is introduced and the Dean and Stark separator is replaced by a Soxhlet device, the cartridge of which is filled with 6.0 g of orthoboric acid. The reaction mixture is then maintained at reflux until complete dissolution of the boric acid. The methanol is then distilled, then the reaction water is removed by azeotropic entrainment. After return to the ambient temperature, the medium is filtered and the xylene is evaporated under low pressure. 92 g of a homogenous and limpid product is recovered, containing:

Ca=10.4% by weight

P=2.8% by weight

S=4.3% by weight

B=0.9% by weight

Example 10

50 g of an overbased calcium sulphonate with an alkaline reserve (TBN) equivalent to 500 mg of KOH per gram of product (in this case 0.4456 basic equivalent) which is dissolved in 350 $cm^3$ of xylene is introduced into a reactor equipped with an agitator, a Dean and Stark separator and a draining funnel. To this medium is added, at 130°, a solution of 39.1 g of an alkylarylsulphonic acid having an average molecular weight equivalent to 700 (that is, 0.056 acid equivalent)in 150 $cm^3$ of xylene. After removal of the reaction water by azeotropic entrainment, at a temperature of within the range of 50° C. and 70° C. a solution of 17.75 g (0.195 acid equivalent) of dithioglycolic acid in 50 $cm^3$ of tetrahydrofuran is introduced. The addition takes between 1 and 2 hours. Following removal of the tetrahydrofuran by distillation, 18.8g (0.048 mole) of phosphorus pentasulphide is dispersed in the medium at the ambient temperature. Then, in 45 minutes, a solution of 4.4 g of water in 80 $cm^3$ of tetrahydrofuran is introduced. The medium is maintained at 50° C. until the phosphorus pentasulphide has disappeared. After adding 20 g of 130 Neutral oil, the medium is filtered, followed by evaporation under low pressure of the solvents. A homogenous and limpid product is recovered, containing:

Ca=6.0% by weight

S=4.7% by weight

P=2.5% by weight

Example 11

50 g of an overbased calcium sulphonate with an alkaline reserve (TBN) equivalent to 410 mg of KOH per gram of product (in this case 0.366 basic equivalent) which is dissolved in 150 $cm^3$ of xylene is introduced into a reactor equipped with an agitator, a Dean and Stark separator and a draining funnel. To this medium is added, at 130°, a solution of 25.1 g of an alkylarylsulphonic acid having an average molecular weight equivalent to 700 (that is, 0.0358 acid equivalent)in 150 $cm^3$ of xylene. After removal of the reaction water by azeotropic entrainment, at a temperature of within the range of 50° C. and 70° C. a solution of 30.0 g (0.165 acid equivalent) of dithioglycolic acid in 80 $cm^3$ of tetrahydrofuran is introduced. The total amount of the alkaline reserve is thereby consumed. The addition takes between 1 and 2 hours. Then 200 $cm^3$ of xylene is added, then the tetrahydrofuran and the reaction water are removed by distillation. The medium is maintained at the reflux temperature of xylene for 2 hours. After return to the ambient temperature, 20 g of 130 Neutral oil is added, then the medium is filtered, followed by evaporation under low pressure of the xylene. 111 g of a homogenous and limpid product is recovered, containing:

Ca=6.7% by weight

S=9.85% by weight

Example 12

50 g of an overbased calcium sulphonate with an alkaline reserve (TBN) equivalent to 410 mg of KOH per gram of product (in this case 0.366 basic equivalent) which is dissolved in 150 $om^3$ of xylene is introduced into a reactor equipped with an agitator, a Dean and Stark separator and a draining funnel. To this medium is added, at 130°, a solution of 25.1 g of an alkylarylsulphonic acid having an average molecular weight equivalent to 700 (that is, 0.0358 acid equivalent) in 150 $om^3$ of xylene. After removal of the reaction water by azeotropic entrainment, 18.3 g (0.0824 mole) of phosphorus pentasulphide is introduced into the reactor at an ambient temperature, and is maintained in a dispersed state by thorough agitation. In 45 minutes, at a temperature not exceeding 50° C., a solution of 7.4 g of water in 50 $cm^3$ of tetrahydrofuran is introduced. The medium is then maintained at 50° C. until the phosphorus pentasulphide disappears, then the tetrahydrofuran and water are removed by distillation. After return to the ambient temperature, the medium is filtered and the xylene is evaporated under low pressure. 77 g of a homogenous and limpid product is recovered, containing:

Ca=9.2% by weight

P=4.7% by weight

S=4.1% by weight

Example 13

50 g of an overbased calcium sulphonate with an alkaline reserve (TBN) equivalent to 420 mg of KOH per gram of product (in this case 0.374 basic equivalent) which is dissolved in 150 $cm^3$ of xylene is introduced into a reactor equipped with an agitator, a Dean and Stark separator and a draining funnel. To this medium is added, at 130°, a solution of 26.6 g of an alkylarylsulphonic acid having an average molecular weight equivalent to 700 (that is, 0.038 acid equivalent) in 150 $cm^3$ of xylene. After removal of the reaction water by azeotropic entrainment, 18.6 g (0.0838 mole) of phosphorus pentasulphide is introduced into the reactor at an ambient temperature, and is maintained in a dispersed state by thorough agitation. In 45 minutes, at a temperature not exceeding 50° C., a solution of 7.6 g of water in 50 $cm^3$ of tetrahydrofuran is introduced. The medium is then maintained at 50° C. until the phosphorus pentasulphide disappears, then the tetrahydrofuran and water are removed by distillation. After return to the ambient temperature, the medium is filtered and the xylene is evaporated under low pressure. 73 g of a homogenous and limpid product is recovered, containing:

Ca=9.6% by weight

P=5.9% by weight

S=4.4% by weight

Example 14

50 g of an overbased magnesium sulphonate with an alkaline reserve (TBN) equivalent to 400 mg of KOH per gram of product (in this case 0.356 basic equivalent) which is dissolved in 150 $cm^3$ of xylene is introduced into a reactor equipped with an agitator, a Dean and Stark separator and a draining funnel. To this medium is added, at 130°, a solution of 23.5 g of an alkylarylsulphonic acid having an average molecular weight equivalent to 700 (that is, 0.0336 acid equivalent) in 150 $cm^3$ of xylene. After removal of the reaction water by azeotropic entrainment, 17.9 g (0.0806 mole) of phosphorus pentasulphide is introduced into the reactor at an ambient temperature, and is maintained in a dispersed state by thorough agitation. In 45 minutes, at a temperature not exceeding 50° C., a solution of 7.3 g of water in 80 $cm^3$ of tetrahydrofuran is introduced. The medium is then maintained at 50° C. until the phosphorus pentasulphide disappears, then the tetrahydrofuran and water are removed by distillation. After return to the ambient temperature, the medium is filtered and the xylene is evaporated under low pressure. A homogenous and limpid product is recovered, containing:

Mg=7.9% by weight

P=3.7% by weight

S=4.0% by weight

Example 15: Examination of the products by infrared spectrometry

Examination of the products prepared in examples 2, 4, 7, 11 and 12 by infrared analysis confirms the total consumption of the carbonate which comprised the core of the micelle in the original products. Indeed, none of the spectra examined showed the characteristic band of carbonate structures at 862cm$^{-1}$ or at 1500 cm$^{-1}$, these bands being present in spectra of overbased sulphonates before modification.

Spectra of the products of examples 2, 4 and 7 (FIGS. 2, 3 and 4) should be compared with the spectrum of the same overbased calcium sulphonate before modification (FIG. 1). The spectra of the products of examples 11 and 12, (FIGS. 6 and 7) should be compared to the spectrum of the same overbased calcium sulphonate before modification (FIG. 5).

In the spectra in FIGS. 1 to 7, the number of waves in cms$^{-1}$ is given on the x axis, and the absorbances given in ordinates.

Example 16: Examination of the products by dialysis in heptane through a latex membrane The products prepared according to the previous examples 2 to 9, 11 and 12 are subjected to dialysis in solution, in normal heptane, through a latex membrane. In each experiment, the by weight fraction which dialyzed (the dialzate) and that which did not dialyse (the concentrate) was determined, the latter forming the colloidal part. The concentration of phosphorus and/or sulphur and/or boron was also determined for each fraction. The results are shown in Table I hereafter.

TABLE I

| PRODUCT OF | CONCENTRATE | | | | DIALYSATE | | | |
|---|---|---|---|---|---|---|---|---|
| | concentrate | CONTENT OF ELEMENTS (% BY WEIGHT) | | | Dialysate | CONTENT OF ELEMENTS (% BY WEIGHT) | | |
| EXAMPLE | (% by weight) | B | P | S | (% by weight) | B | P | S* |
| 2 | 53.0 | | | 16.2 | 47.0 | | | 0.3 |
| 3 | 69.5 | 6.1 | | | 30.5 | 0.0 | | |
| 4 | 61.6 | 13.9 | | | 28.4 | 0.0 | | |
| 5 | 58.0 | 11.8 | | | 42.0 | 0.0 | | |
| 6 | 68.9 | | 6.7 | 6.3 | 31.1 | | 0.0 | 0.3 |
| 7 | 68.3 | | 7.9 | 5.8 | 31.7 | | 0.0 | 0.3 |
| 8 | 68.1 | | 4.1 | 4.8 | 31.9 | | 0.0 | 0.4 |
| 9 | 66.9 | 1.3 | 4.2 | 5.9 | 33.1 | 0.0 | 0.0 | 0.8 |
| 11 | 56.1 | | | 17.2 | 43.9 | | | 0.5 |
| 12 | 62.2 | | 8.1 | 6.0 | 37.8 | | 0.0 | 0.8 |

*The sulphur content of 130 Neutral oil used during synthesis is 0.3% mass.

Examination of the results indicates that sulphur, boron and phosphorus contained in the products according to the invention are found integrally in the concentrate (that is to say in the colloidal fraction) after dialysis and are absent from the dialyzate.

Example 17: Evaluation of the wear-resistance and extreme pressure properties

The products according to the invention are evaluated for their wear resistance and extreme pressure properties in a 130 Neutral mineral oil. The wear resistance and extreme pressure performances are evaluated on a 4 ball machine according to the ASTM D 2783 norm. The results are shown in Table II hereafter.

TABLE II

| PRODUCT OF | CONCENTRATION/OIL (% BY WEIGHT) | | WEAR RESISTANCE AND EXTREME PRESSURE PERFORMANCE ON 4 BALL MACHINE | | |
|---|---|---|---|---|---|
| | | | Load/wear index | | Diameter of impression after 1 hour at 40 daN |
| EXAMPLE | Additive | Ca | (daN) | Weld load | (mm) |
| 2 | 10 | 0.61 | 44 | 315 | 0.47 |
| 6 | 10 | 0.81 | 48 | 315 | 0.48 |

TABLE II-continued

| PRODUCT OF EXAMPLE | CONCENTRATION/OIL (% BY WEIGHT) Additive | Ca | WEAR RESISTANCE AND EXTREME PRESSURE PERFORMANCE ON 4 BALL MACHINE Load/wear index (daN) | Weld load | Diameter of impression after 1 hour at 40 daN (mm) |
|---|---|---|---|---|---|
| 6 | 15 | 1.22 | 60 | 400 | 0.43 |
| 7 | 10 | 0.87 | 50 | 315 | 0.42 |
| 7 | 15 | 1.29 | 67 | 400 | 0.43 |
| 8 | 10 | 0.91 | 44 | 315 | 0.41 |
| 9 | 10 | 1.04 | 41 | 250 | 0.40 |
| 12 | 10 | 0.92 | 53 | 315 | 0.41 |
| 13 | 10 | 0.96 | 52 | 315 | 0.44 |
| Comparative examples | | | | | |
| Colloidal CaCO3 with 11.90% Ca | 5 | 0.59 | 29 | 170 | 0.75 |
| | 10 | 1.19 | 36 | 200 | 0.36 |

We claim:

1. A modified colloidal product obtained by a method comprising:

step (a) providing an original colloidal product having a basicity reserve and containing at least one alkaline-earth metal carbonate in micelle form, said original colloidal product having been reacted with at least one compound selected from the group consisting of alkylsulphonic and alkylarylsulphonic acids, salts thereof and long chain aliphatic carboxylic acids and salts thereof in such a way as to modify a proportion of the basicity reserve of the original colloidal product of not more than 70% and step (b) completely neutralizing the residual basicity reserve of said colloidal product from step (a) with at least one acid containing at least one element selected from the group consisting of boron, phosphorus and sulphur so as to obtain a new micelle devoid of carbonate without affecting the colloidal stability of the resultant product.

2. A modified colloidal product according to claim 1, wherein said original colloidal product essentially comprises at least one alkaline earth metal carbonate micellized by an alkaline earth metal sulphonate and having a basicity reserve of 200 to 600 mg of potassium per gram.

3. A modified colloidal product according to claim 1, wherein the original colloidal product in step (a) has been reacted with a quantity of acid or salt sufficient to cause the modification to affect a proportion of 30 to 60% of the basicity reserve of the original colloidal product.

4. A modified colloidal product according to claim 1, wherein in step (b), a mineral or organic acid containing at least one element selected from the group consisting of boron, phosphorus and sulphur is directly introduced into a reaction medium resulting from the reaction in step (a).

5. A modified colloidal product according to claim 4, wherein said mineral acid is orthoboric or metaboric acid or phosphoric acid or derivatives thereof, and said organic acid is a sulphurated carboxylic acid corresponding to the general formula $X—R^1—S_x—R^3—S_y—R^2—COOH$ in which $R^1$ and $R^2$ each represent a divalent hydrocarbon radical, $R^3$ represents a simple bond or a divalent hydrocarbon radical, X represents a hydrogen atom or a carboxylic grouping; x and y each have an average value of 1 to 4 when $R^3$ is a divalent hydrocarbon radical, and the sum (x+y) has an average value of 1 to 4 when $R^3$ represents a simple bond.

6. A modified colloidal product according to claim 1, wherein in in step (b) the acid containing at least one element selected from boron, phosphorus and sulphur is formed in situ.

7. A modified colloidal product according to claim 6, wherein said acid is formed in situ from a reaction of (a) a phosphorus sulphide, a phosphorus oxide, a boron oxide or mixtures thereof with (b) water, an aliphatic monoalcohol or mixtures thereof.

8. A modified colloidal product according to claim 1, wherein at least step (b) of the method is carried out in an organic solvent comprising an aliphatic, cycloaliphatic or aromatic hydrocarbon.

9. A modified colloidal product according to claim 8, wherein said organic solvent further comprising a cosolvent selected from the group consisting of tetrahydrofuran and methanol.

10. A modified colloidal product according to claim 8, wherein at least step (b) of the method is carried out at a temperature from the ambient temperature to the reflux temperature of the solvent used.

11. A modified colloidal product according to claim 8, wherein at least step (b) of the method is carried out in a dilution oil.

12. A modified colloidal product according to claim 1, wherein comprising up to approximately 15% by weight of boron and/or up to 30% by weight of sulphur and/or up to approximately 15% by weight of phosphorus as well as up to approximately 25% by weight of calcium and/or up to approximately 20% by weight of magnesium.

13. A lubricating composition wherein it comprising a major proportion of at least one mineral or synthetic lubricant and a minor proportion of at least one colloidal product according to claim 1.

14. A lubricating composition according to claim 13, wherein the colloidal product is incorporated therein at a concentration of 0.1 to 25% by weight.

15. A modified colloidal product according to claim 1, said original colloidal product having been reacted in an alkyl sulfonic acid, an alkyl aryl sulfonic acid, a carboxylic acid, or salts thereof, and wherein the residual basicity reserve of the resultant product is neutralized by acid comprising an acid derived from phosphorus sulfide.

16. A modified colloidal product according to claim 15, wherein said acid further comprises a boric acid or a sulfur-containing carboxylic acid.

17. A modified colloidal product according to claim 16, wherein said further acid is a boric acid.

18. A modified colloidal product according to claim 16, wherein said further acid is a sulfur-containing carboxylic acid.

19. A lubricating composition comprising a major proportion of at least one mineral or synthetic lubricant and a minor proportion of at least one modified colloidal product according to claim 15.

20. A lubricating composition comprising a major proportion of at least one mineral or synthetic lubricant and a minor proportion of at least one modified colloidal product according to claim 16.

21. A modified colloidal product according to claim 1, said original colloidal product having been reacted with sulfonic acid or carboxylic acid or salts thereof and a sulfur-containing acid.

22. A method of forming a colloidal product comprising:

(a) providing an original colloidal product having a basicity reserve and containing at least one alkaline-earth metal carbonate in micelle form, (b) reacting the original colloidal product selected from the group consisting of alkylsulphonic and alkylarylsulphonic acids, salts thereof and long chain aliphatic carboxylic acids and salts thereof in such a way as to modify a proportion of up to 70% of the basicity reserve of the original colloidal product, and (c) neutralizing the residual basicity reserve of said colloidal product from step (b) by at least one acid containing at least element selected from the group consisting of boron, phosphorus and sulfur.

23. A colloidal product according to claim 2, wherein the original colloidal product in step (a) has been reacted with a quantity of acid or salt sufficient to cause the modification to affect a proportion of 30 to 60% of the basicity reserve of the original colloidal product.

24. A method according to claim 21, wherein the original colloidal product essentially comprises at least one alkaline earth metal carbonate micellized by an alkaline earth metal sulphonate and having a basicity reserve of 200 to 600 mg of potassium per gram, and wherein the quantity of acid or salt in step (b) is sufficient to affect a proportion of 30 to 60% of the basicity reserve of the original colloidal product.

25. A modified colloidal product according to claim 1, having a weight ratio of the total of boron, phosphorus and sulphur to the total of alkaline earth metals of at least 0.68.

26. A modified colloidal product according to claim 2, having a weight ratio of the total of boron, phosphorus and sulphur to the total of alkaline earth metals of at least 0.68.

27. A modified colloidal product according to claim 3, having a weight ratio of the total of boron, phosphorus and sulphur to the total alkaline earth metals of at least 0.68.

28. A modified colloidal product according to claim 23, having a weight ratio of the total of boron, phosphorus and sulphur to the total alkaline earth metals of at least 0.68.

* * * * *